United States Patent [19]

Helfer et al.

[11] Patent Number: 4,655,431

[45] Date of Patent: Apr. 7, 1987

[54] RAM-TYPE BLOWOUT PREVENTER

[76] Inventors: Paul E. Helfer, 7810 Moonmist, Houston, Tex. 77036; Marvin R. Jones, 414 Flintdale Rd., Houston, Tex. 77024

[21] Appl. No.: 798,135

[22] Filed: Nov. 13, 1985

Related U.S. Application Data

[63] Continuation of Ser. No. 439,590, Nov. 5, 1982, abandoned.

[51] Int. Cl.[4] ..... E21B 33/06

[52] U.S. Cl. ..... 251/1.3; 251/77; 277/29; 277/75; 277/235 A

[58] Field of Search ..... 251/1.1, 1.2, 1.3, 77; 277/235 A, 75, 79, 29

[56] References Cited

U.S. PATENT DOCUMENTS

| | | | |
|---|---|---|---|
| 931,228 | 8/1909 | Schutte . | |
| 1,064,660 | 6/1913 | Klee | 251/84 |
| 1,157,870 | 10/1915 | Houser . | |
| 1,836,506 | 12/1931 | Rasmussen et al. . | |
| 2,177,164 | 10/1939 | Baash . | |
| 2,795,391 | 6/1957 | Krone et al. | 251/38 |
| 2,883,141 | 4/1959 | Oliver . | |
| 2,946,550 | 7/1960 | Wilde . | |
| 3,036,807 | 5/1962 | Lucky et al. | 251/1.3 |
| 3,216,334 | 11/1965 | Bauer | 92/158 |
| 3,285,287 | 11/1966 | Curran | 137/630 |
| 3,318,577 | 5/1967 | Banks | 251/332 |
| 3,601,157 | 8/1971 | Milleville | 137/630.14 |
| 3,612,476 | 10/1971 | Leitgeb | 251/38 |
| 4,024,884 | 5/1977 | Prescott et al. | 251/38 |
| 4,253,638 | 3/1981 | Troxell, Jr. | 251/1.3 |
| 4,266,468 | 5/1981 | Biggs | 92/158 |
| 4,359,203 | 11/1982 | Cho | 251/77 |
| 4,408,765 | 10/1983 | Adelmann, Jr. | 277/29 |

OTHER PUBLICATIONS

*Composite Catalog,* 1974–1975, p. 1034; 1980–1981, pp. 1040–1042; and 1980–1981, p. 5216.

*Primary Examiner*—Martin P. Schwadron
*Assistant Examiner*—Sheri M. Novack
*Attorney, Agent, or Firm*—Vinson & Elkins

[57] ABSTRACT

An improved blowout preventer having a body with a central bore and aligned opposed passages extending out from the central bore, a ram assembly in each of the passsages and including a ram body with a face seal, a rear slot, a first passage through the body from above the face seal into the slot, a second passage through said body from below the face seal into the slot, a pressure responsive actuator, a connector extending from the actuator to the ram body and having a disc end positioned in and movable axially in said slot to close and open flow through said ram body passages, a third passage through said ram body from above said face seal to the rear of the ram body, a fourth passage through said ram body from below said face seal to the rear of the ram body and means coacting with said third and fourth passages to allow fluid flow to the rear of said ram body and to prevent fluid flow to the front of said ram body.

9 Claims, 6 Drawing Figures

RAM-TYPE BLOWOUT PREVENTER

Cross Reference to Related Applications

This application is a continuation of the prior copending application Ser. No. 439,590, filed Nov. 5, 1982 now abandoned.

This application is a copending related application of the prior copending application Ser. No. 337,383, filed Jan. 6, 1982. Cameron Iron Works, Inc. claims ownership of this application by virtue of employment agreements with the inventors.

BACKGROUND

The present invention relates to an improved ram-type blowout preventer to be used in drilling an oil and gas well to close the well bore and prevent the uncontrolled exhausting of well fluids therethrough.

In ram-type blowout preventers of the prior art it has been common practice to conduct well pressure to the rear of the rams when they are closed to provide an additional force urging the rams closed. In one prior art device (U.S. Pat. No. 3,036,807) a structure is provided to reduce the power requirements for opening the rams by including a valve means which is opened and closed by pressure used to actuate the piston. When in one position such valve means allows communication only between rear of the ram and the well bore above the face seal at the ram and in its other position allows communication only between the rear of the ram and the well bore below the face seal of the ram.

SUMMARY

The present invention is an improved ram-type blowout preventer with passages between the front and rear of the ram above and below the face seal and valve means on the connecting rod between the ram and the pressure responsive actuator to close such passages with initial closing movement of the connecting rod and to open such passages with initial opening movement of the connecting rod. Also, passages between the face and rear of the ram above and below the face seal include valve means which allow flow through such passages only from the front to the rear of the ram.

An object of the present invention is to provide an improved ram-type blowout preventer of simple construction which vents pressure behind the rams before opening.

Another object is to provide an improved ram-type blowout preventer having means to control the fluid pressure behind the rams with no outside connections.

A further object is to provide an improved ram-type blowout preventer in which the highest pressure in its central bore is conducted to the rear of the rams when they are closed.

BRIEF DESCRIPTION OF THE DRAWINGS

These and other objects and advantages of the improved device of the present invention are hereinafter set forth and explained with respect to the structure shown in the drawings wherein.

DESCRIPTION OF THE PREFERRED EMBODIMENTS

Figure 1:
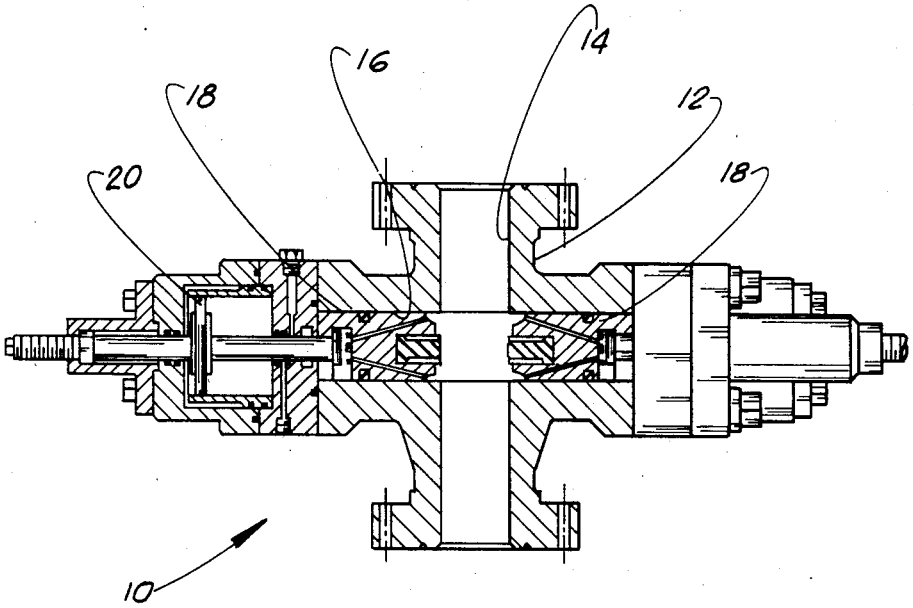
FIG. 1 is a vertical sectioned view of the improved blowout preventer of the present invention.

The improved ram-type blowout preventer 10 is shown in FIG. 1 and includes body 12 with central bore 14 therethrough and aligned, opposed passageways 16 extending outwardly from central bore 14 with ram assemblies 18 positioned in passageways 16 for movement into and retraction from central bore 14 responsive to movement of actuation means, such as pistons 20.

Figure 2:
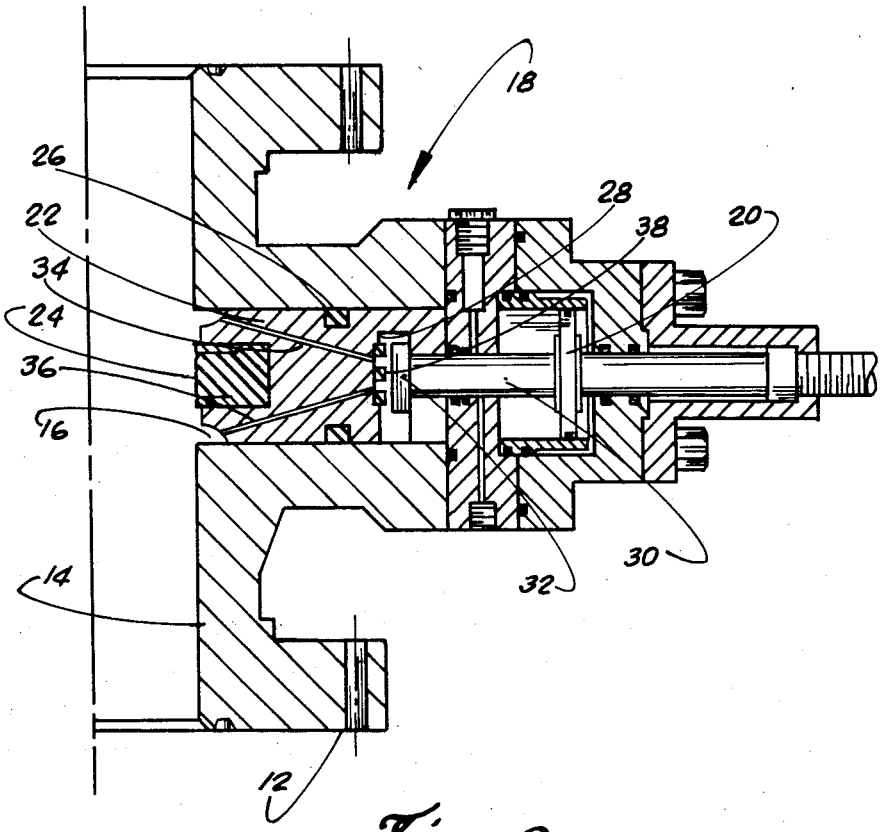
FIG. 2 is a partial vertical sectional view showing one ram assembly of the improved blowout preventer shown in FIG. 1 with the ram in open or retracted position.
Figure 3:
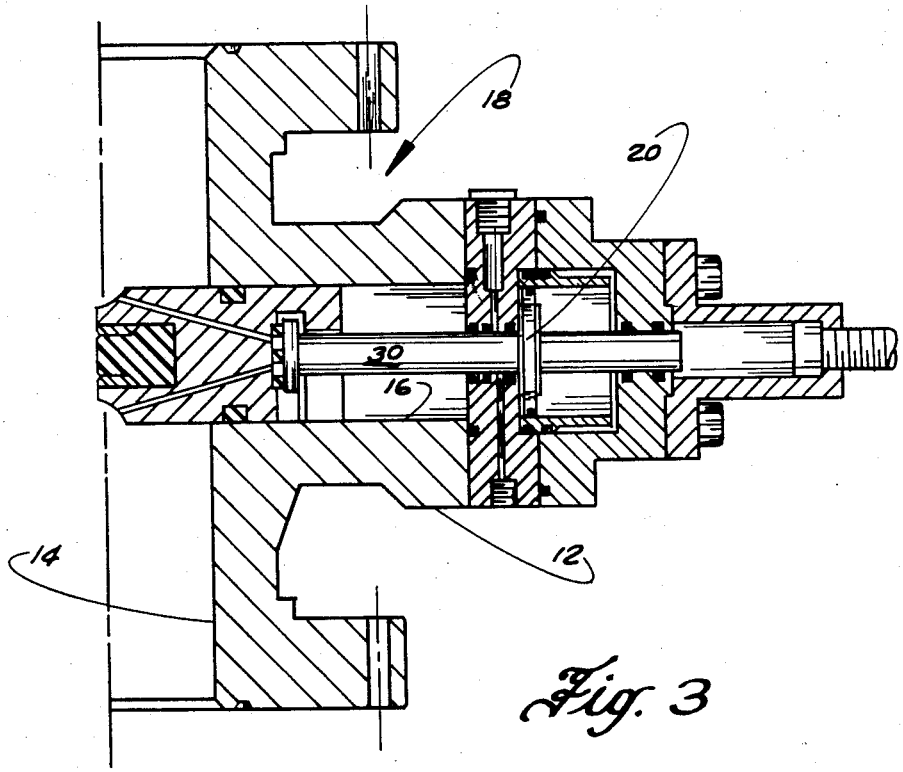
FIG. 3 is a view similar to FIG. 2 but showing the ram in extended or closed position.

Each ram assemblies 18 includes ram body 22, face or front seal 24, circumferential seal 26 and rear slot 28, as hereinafter described and best shown in FIGS. 2 and 3. The ram assemblies 18 shown are blind rams which may be used to close the central bore 14 when no section of the drill string extends therethrough. However, the present invention has application to other types of ram assemblies such as those which can close and seal off the central bore 14 when a section of drill string extends therethrough. Seal 26 which extends around ram body 22 seals against the interior of its passageway 16. Face seal 24 has side members 25 which cooperate with seal 26 to seal the central bore 14. Connecting rod 30 is connected to piston 20, extends into passageway 16 with enlargement 32 on its inner end positioned within slot 28 to connect piston 20 to ram body 22. This connection between piston 20 and ram body 22 includes a lost motion connection which allows a small initial movement of piston 20 and connecting rod 30 prior to the initial movement of ram body 22.

Passages 34 and 36 extend through ram body 22 from above and below face seal 24, respectively, into slot 28 on the rear face of ram body 22. Suitable seals 38 surround the openings of passages 34 and 36 into slot 28 and coact with the forward face of enlargement 32 to provide a valve means controlling the flow through passages 34 and 36. Thus, as piston 20 and connecting rod 30 are moved inward or held in their inward or closed positions with ram assemblies 18 sealing central bore 14 enlargement 32 engages and closes communication through passages 34 and 36. As shown in FIG. 3, it should be noted that with such valve means closed there is no communication into slot 28 through passages 34 and 36. When piston 20 and connecting rod 30 are initially moved to the rear, enlargement 32 disengages from seals 38 to allow free flow through and between passages 34 and 36 as shown in FIG. 2. This opening of passages 34 and 36 allows venting of fluid pressure from behind ram body 22 to eliminate the force which such pressure creates in a direction opposing the opening or outward movement of ram assemblies 18.

Figure 4:
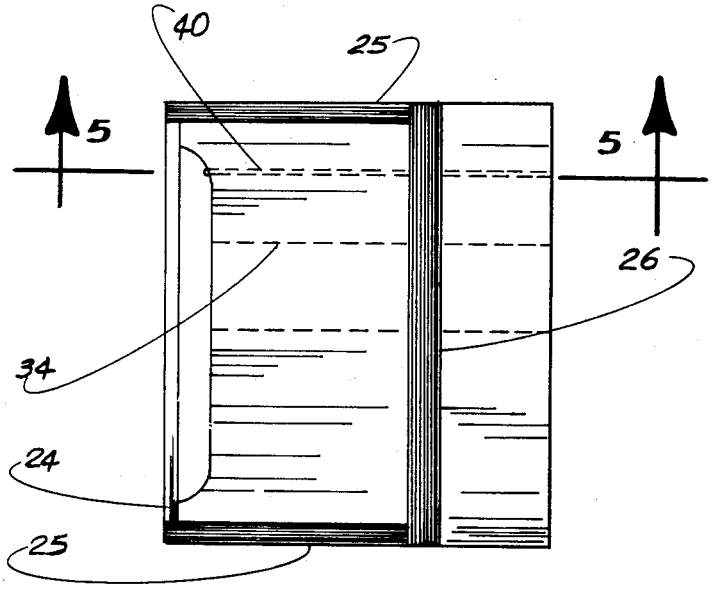
FIG. 4 is a plan view of the blowout preventer ram of the present invention.
Figure 5:
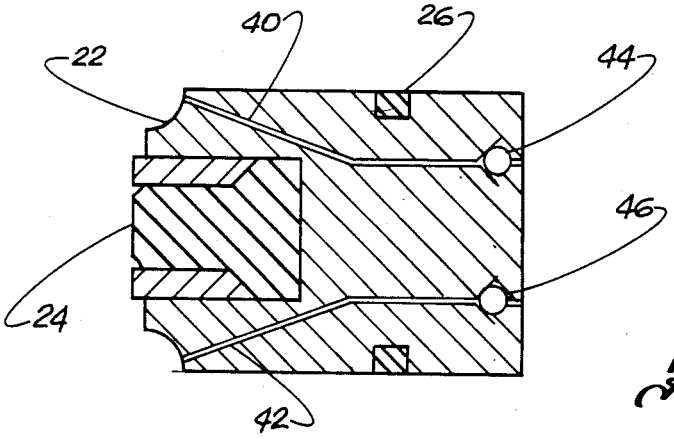
FIG. 5 is a sectional view taken along line 5—5 in FIG. 4 showing one means providing one-way communication from the front to the rear of the ram.

Since it is desirable in ram assemblies which have a circumferential seal to provide some means for communicating fluid pressure within the central bore to the rear of the ram so that the ram body is pressure balanced, passages 40 and 42, shown in FIGS. 4 and 5, extend through ram body 22. Passage 40 communicates from a position on the face of ram body 22 above face seal 24 through check valve 44 to the rear of ram body 22. Passage 42 communicates from a position on the face of ram body 22 below face seal 24 through check valve 46 to the rear of ram body 22. Check valves 44 and 46 are positioned to allow flow through their respective passages to the rear of ram body 22 but to prevent flow in the opposite direction. Also, passages 40 and 42 are offset to one side of ram body 22 from passages 34 and 36 so that flow is not controlled by the valving action of enlargement 32 on seals 38.

Figure 6:
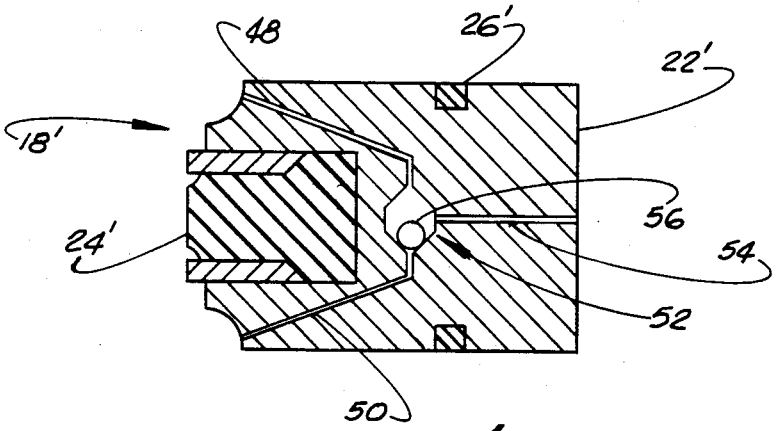
FIG. 6 is a similar sectional view of a ram having a modified form of one-way communication from the front to the rear of the ram.

An alternate form of one-way communication through the ram body 22' is shown in FIG. 6. In this form passages 48 and 50 extend through ram body 22' from above and below face seal 24', respectively, to shuttle valve 52 which is designed to allow flow from the bore area of higher pressure and prevent flow to the bore area of lower pressure. Passage 54 extends from shuttle valve 52 to the rear of ram body 22'. If the ram assemblies 18' are closed, then the flow is provided to the rear of the ram bodies 22' through passages (such as 34 and 36 not shown in FIG. 6). As pressure in the central bore 14' builds below the ram face seal 24' it is communicated through passage 50 to shuttle valve 52. Such pressure moves the valving mechanism thereof (ball 56 in FIG. 6) to a position closing passage 48 and allowing flow through passage 54 to the rear of ram body 22'. This provides a pressure balancing of the ram body 22' so that the actuator is not required to work against a pressure differential on the ram bodies to retain the ram assemblies in closed position. Also with the lost motion valving means the initial movement of the connecting rod equalizes the pressure between the back of the ram and the face so that the actuating means does not work against a pressure differential across the ram body resulting from the pressure fluid behind the ram body.

Additionally with either form of the present invention, any build-up of pressure above the face seal 24 which is higher than the pressure below the face seal 24 is communicated to the rear of ram body 22. This provides an improved structure, which employs pressure differential across the face seal to aid in closing the ram assemblies and which will hold pressure from either direction equally well. Also the lost motion valving means is provided to allow venting of pressure fluids behind the ram body.

What is claimed is:

1. A blowout preventer comprising a body having a central bore and aligned passages extending outwardly from opposite sides of said bore, a ram assembly in each of said passages, each of said ram assemblies including a ram body having a face seal, a rear surface and seal means coacting with said face seal to isolate the passage behind said ram body from said central bore above said face seal, pressure responsive means, a passageway through said ram body from the central bore above said ram body face seal to the rear of said ram body and opening through said rear surface, and a lost motion connection between between said ram body and said pressure responsive means, said lost motion connection including valve means for engaging said rear surface of said ram body in surrounding relation to the rear opening of said passageway to open and close said passageway responsive to movement of said lost motion connection whereby when said connection is urged inwardly said valve means closes said passageway and when said connection is urged outwardly said valve means is moved away from said passageway to establish communication between the passage behind said ram body and said central bore above said face seal.

2. A blowout preventer comprising a body having a central bore and aligned passages extending outwardly from opposite sides of said bore, a ram assembly in each of said passages, each of said ram assemblies including a ram body having a face seal, a top seal extending from said face seal on each side of said ram body across the top of said ram body and a rear surface, pressure responsive means, a passageway communicating from the central bore above said ram body face seal to the central portion of the rear surface of said ram body, means for communicating from the central bore below said ram body face seal to the rear of said ram body, and a lost motion connection between said ram body and said pressure responsive means, said lost motion connection including connecting means having valve means to open said passageway with opening movement of said pressure responsive means and to close said passageway with closing movement of said pressure responsive means.

3. A blowout preventer comprising a body having a central bore and aligned passages extending outwardly from opposite sids of said bore, a ram assembly in each of said passages, each of said ram assemblies including a ram body having a face seal extending transversely thereof, a top seal extending across the top of said ram body and coacting with said face seal to isolate the rear of said ram body from said central bore above said face seal and a rod connecting slot in the rear of said ram body, a first passageway extending through said ram body from a position in the front of said ram body below said face seal to said slot, a second passageway extending through said ram body from a position in the front of said ram body above said face seal to said slot, a seal around the opening of said first passageway in said slot, a seal around the opening of said second passageway in said slot, pressure responsive means, and a connecting and connected to said pressure responsive means and having an enlarged disc-shaped end positioned in said rod connecting slot, said disc-shaped end being of a substantially smaller front to rear dimension than said slot, said disc-shaped end engaging said seals in said slot to prevent flow through said first and second passageways when said pressure responsive means urges said rod toward said body central bore and disengaging from said seals to allow flow through said first and second passageways when said pressure responsive means urges said rod away from said body bore.

4. A blowout preventer according to claim 3 including a third passageway through said ram body from the front to the rear thereof, and means coacting with said third passageway to allow fluid flow to the rear of said ram body and to prevent fluid flow to the front of said body.

5. A blowout preventer according to claim 4 wherein said third passageway extends from a position below the face seal on the front of said ram body, and including a fourth passageway extending through said ram body from a position above said face seal to the rear or said ram body, fluid flow through said fourth passageway being controlled by said coacting means to allow flow to the rear or said ram body and to prevent flow to the front of said ram body.

6. A blowout preventer according to claim 5 wherein said coacting means includes a check valve in said third passageway, and a check valve in said fourth passageway.

7. A blowout preventer according to claim 5 wherein said coacting means includes a shuttle valve connecting said third and fourth passageways.

8. A blowout preventer according to claim 1 including means for communicating between the rear surface of said ram body and said central bore below said face seal.

9. A blowout preventer comprising a body having a central bore and aligned passages extending outwardly from opposite sides of said bore, a ram assembly in each of said passages, at least one of said ram assemblies including a ram body having a face seal, a rear surface and seal means coacting with said face seal to isolate the passage behind said ram body from said central bore above said face seal, pressure responsive means, a passageway through said ram body from the central bore above said ram body face seal to the rear of said ram body and opening through said rear surface, and a lost motion connection between said ram body and said pressure responsive means, said lost motion connection including valve means for engaging said rear surface of said ram body in surrounding relation to the rear opening of said passageway to open and close said passageway responsive to movement of said lost motion connection whereby when said connection is urged inwardly said valve means closes said passageway and when said connection is urgedd outwardly said valve means is moved away from said passageway to establish ccommunication between the passage behind said ram body and said central bore above said face seal.

* * * * *